United States Patent [19]

Bosoni et al.

[11] Patent Number: 4,899,825

[45] Date of Patent: Feb. 13, 1990

[54] CONTINUOUS MIXING DEVICE, PARTICULARY SUITABLE FOR PREPARING AQUEOUS SOLUTIONS OF FOAM EXTINGUISHER FOR FIRE-FIGHTING SYSTEMS

[75] Inventors: Marco Bosoni, San Donato Milanese; Roberto Brusoni, Bollate; Carlo Fiorentini, Rho; Pietro Fracassi, Milan, all of Italy

[73] Assignees: Snamprogetti, S.p.A., Milan; Tecsa S.r.l., Levate; Allweiler Italia, S.p.A., Opera, all of Italy

[21] Appl. No.: 197,978

[22] Filed: May 24, 1988

[30] Foreign Application Priority Data

Jun. 25, 1987 [IT] Italy ..... 21040 A/87

[51] Int. Cl.[4] ..... A62C 35/16

[52] U.S. Cl. ..... 169/14; 169/5; 169/15

[58] Field of Search ..... 169/5, 13, 14, 15, 16; 222/134; 137/99

[56] References Cited

U.S. PATENT DOCUMENTS

| | | | |
|---|---|---|---|
| 2,009,622 | 7/1935 | Kennedy | 137/99 |
| 2,601,849 | 7/1952 | Lee II | 137/99 |
| 2,696,266 | 12/1954 | Tuve | 169/14 |
| 3,053,842 | 9/1962 | Meissner | 137/99 |
| 3,115,158 | 12/1963 | Sheppard | 169/14 |
| 4,448,256 | 5/1984 | Eberhardt | 169/15 |

FOREIGN PATENT DOCUMENTS

| | | | |
|---|---|---|---|
| 2720334 | 5/1977 | Fed. Rep. of Germany | 137/99 |
| 3131522 | 4/1983 | Fed. Rep. of Germany . | |
| 1150189 | 1/1958 | France . | |
| 117899 | 12/1925 | Switzerland . | |

*Primary Examiner*—Joseph F. Peters, Jr.
*Assistant Examiner*—Anne Sartelle
*Attorney, Agent, or Firm*—Hedman, Gibson, Costigan & Hoare

[57] ABSTRACT

A device for continuously delivering a proportionately constant fire-fighting solution which comprises an extinguisher foam mixed with variable flow rates of fire fighting water. The device comprises a motor, which is a volumetric screw pump driven in reverse by the hydraulic pressure of the fire fighting water network. This hydraulic motor is mechanically connected to one or more volumetric pumps which proportionally meter the fire fighting foam extinguisher liquid into the network water.

8 Claims, 2 Drawing Sheets

CONTINUOUS MIXING DEVICE, PARTICULARY SUITABLE FOR PREPARING AQUEOUS SOLUTIONS OF FOAM EXTINGUISHER FOR FIRE-FIGHTING SYSTEMS

FIELD OF THE INVENTION

The object of the present invention is a device for continuously preparing proportionately constant solutions with large variable, flowrates.

The device according to the present invention is particularly suitable for preparing foam-extinguisher solutions for industrial fire-fighting systems.

BACKGROUND OF THE INVENTION

The fire-fighting systems of industrial factories, e.g., chemical plants, petrochemical plants, petroleum refineries and well-drilling plants, require that a foam extinguisher be mixed and added at a constant proportion to the water of the fire-fighting network, which is supplied by suitable pumps, to obtain a proper foam extinguisher solution. When the solution is delivered, e.g., by means of the spreaders, it generates a foam which extinguishes the flames, while maintaining, under any operating conditions, its fire-extinguishing characteristics.

Many foam-extinguishers are known in the prior art, which are suitable for use in fire extinguishing. They perform to the maximum extent when they are used in the prescribed proportion of fire-fighting water to foam-extinguisher liquid. In the following, such "foam-extinguisher liquid" is also referred to as an "additive" or "concentrate".

When an excessive amount of foam-extinguisher liquid is used, a lower fire-extinguishing quality is obtained, because with increasing proportions, beyond a certain limit, undesirable or negative results are likely to result on the characteristics of the generated foam, e.g., an excessive increase in foam viscosity, hinders the flowing of the foam.

Additionally, further disadvantages exist, such as an increase in the specific cost of the foam-extinguisher per unit of fire-fighting solution, a shorter autonomy of operation of the fire-fighting system, and the need for the operators to take more frequent actions in order to handle and replenish the foam-extinguisher liquid consumed.

These two disadvantages, can be critical in the emergency situation of a fire.

On the other hand, when too low a ratio of foam extinguisher to water is used, the foam that is produced loses its fire extinguishing properties very rapidly.

In any case, the accuracy of the proportioning of the foam-extinguisher additive should be maintained within specific limits of not higher than +20%, or even less, in order to attain the best effect.

In the present fire-fighting systems, the most commonly used foam-extinguishers are used in aqueous solutions at concentrations at 6%, but the most recent additives are designed for use at 3%, or even at 1%. This is to reduce the amount of foam-extinguisher additive required to be kept in storage, or needed to be purchased under emergency situations, while maintaining the autonomy of operation or, on the contrary, to increase the autonomy of operation while maintaining the same volume of stored additive.

Such a problem proves to be very important, because the flowrates required for fire extinguishing are very high, and the amount of foam-extinguisher—even when used at low percentages—are always considerable.

Depending upon the number of fire-fighting nozzles used, the delivered flowrate of the fire-fighting solution varies within a very wide range, and within this range, the precision in additive addition should be maintained, even during an emergency situation such as a fire.

A further requirement concerns the preparation of the solutions. The possibility that the stored amounts of a type of additive—e.g., a foam-extinguisher which is properly to be used at 6% solution may be exhausted. In these circumstances the device should easily adapt in order to conform to the different proportions of water required for a different foam extinguisher.

A further, and extremely important requirement of fire-fighting systems is that the mixing devices must preferably operate in a stand-alone mode—without energy being supplied from the external environment because under emergency conditions, there could be a severe deficiency of available energy.

In the prior art, many devices for continuous mixing were proposed, but, from a general standpoint, these mixing devices use ejectors which are driven by the energy supplied by the pressure of the fire-fighting system water. These ejectors withdraw the foaming additive from the tank by the depressure generated by the ejector.

DESCRIPTION OF THE PRIOR ART

A typical embodiment of a device described in the prior art is shown in FIG. 1. The mixing device depicted in the diagram of FIG. 1 comprises one or more pressurized storage tanks 1, inside which a second container is installed, which is a bag 2 made from a flexible material.

The foam-extinguisher additive is contained inside the flexible bag container 2. The hollow space A located between said container 2 and the wall of the tank 1 is occupied by the same water of the fire-fighting system.

The fire-fighting network water is delivered under pressure by means of a duct 3, in which a Venturi device 4 is installed.

Upstream of the Venturi device 4, water is branched off, and fills the hollow space A between the tank 1 and the container 2, and pressurizes the tank, through the pipe 5, which can be closed by means of the valve 6.

Said valve 6 is of the on-off type, and is only closed when refilling the foam-extinguisher additive, or if shutdown of the device occurs.

Near the narrowest section of the Venturi device 4 due to the effect of water flow, an area B of relative depressure is formed. Pipe 7 connects said area B of relative low pressure to the flexible container 2, which is completely filled with the foam-extinguisher additive.

Pipe 7 is shut off by a valve, 8, similar to valve 6.

Downstream of the Venturi device 4, the water/-foam-extinguisher additive solution is distributed to the user device by means of the duct 9.

When water is not flowing inside the Venturi device 4 low pressure is not generated, and therefore both the pipes 5 and 7, the hollow space A and the interior of the container 2, are under the same pressure.

When water flows through the duct 3 and the Venturi device 4, in the operation of the device, the water flow generates low pressure in the area B, relative to the pressure existing inside the duct 5 and the area A. The pressure difference generated inside area A compresses the flexible container 2 and the foam-extinguisher additive contained therein is discharged through the pipe 7 and is mixed with the fire-fighting water in B. The greater the flowrate of fire-fighting water inside the Venturi device 4, the lower the pressure in the area B, and the greater the flowrate of the foam-extinguisher additive. The ratio of the additive to the water remains fairly constant to the prefixed average value with variable flow-rates.

The embodiment described in the diagram of FIG. 1 is at present the most commonly used for variable-flowrate stationary fire-fighting installations. In a widely used alternative, the functions of the container 2 and of the hollow space A can be inverted, with the foam-extinguisher additive being contained inside the hollow space A, and the driving water being contained inside the container 2. Of course, in that case the connections to the Venturi device 4 must be inverted.

The technical advantages shown by the prior art is its structural simpleness and the absence of moving parts.

Furthermore, such a device is not affected by changes in absolute pressure, and does not require sophisticated control instrumentation.

However, some drawbacks and limitations exist. One such drawback is the mixing precision which can be obtained by such an apparatus decreases with decreasing values of the prescribed added percentages.

The apparatuses according to the diagram of FIG. 1 show considerable difficulties adapting to the most recent foam fire-extinguishers, for which the low addition levels of 3%, and even of 1%, are prescribed.

Another weak point of the prior art is the membrane container 2, which is susceptible to sudden breakages. This often occurs during an emergency situation. In order to obviate such drawbacks, suggestions are made in the prior art, to replace the membrane container 2 with a water-tight piston which slides in the axial direction to separate the fire-fighting water from the fire-extinguisher additive. This solution suffers from a number of operating drawbacks, for example size and refilling limitations.

In fire-fighting systems, the rated flowrates required for such systems may have values of up to 500–1,000 $m^3$/hour, and that with the conventional foaming additives to be metered at a 6% rate, the hourly consumption of additive may be as high as 30–60 $m^3$/hour.

The tanks utilizing a membrane-container have size limits, which are dictated by practical reasons for example, operations and maintenance. They have approximately 10 $m^3$ of useful capacity, which corresponds for a fire-fighting system with an addition rate of 6%, and a rated flowrate of 500 $m^3$/hour to an operating time of 20 minutes at peak flowrate.

The tank 1 must be designed for operating under a pressure at least equal to the maximum pressure envisaged for the fire-fighting network. This can be considerably high, up to 10–15 bar.

Under such operating conditions, a tank 1 must be taken out of service for short time intervals, and replaced by another, ready, tank 1.

The refilling procedure is conducted by closing the valves 6 and 8, opening the valve 10 to refill the foam-extinguisher additive which is delivered by the service pump 11 though the line 12, and letting the pressurizing water contained inside the hollow space A drain by means of the valve 13.

As one can easily deduce, a high number of operators is required to manage the mixing devices, and to refill the many emptied tanks, when a fire emergency occurs. A further drawback affecting the apparatus as depicted in FIG. 1, is during a fire it has a poor adaptability to receive different additives which are to be used different concentrations e.g., the additive stored in the factory is finished and for example, such immediately available materials would require a new calibration of the Venturi device 4.

SUMMARY OF THE INVENTION

The device according to the present invention overcomes the above-discussed drawbacks and limitations of the devices known from the prior art characterized by both an extreme simpleness and a complete autonomy of operation from external sources of energy. The device according to the present invention is essentially a volumetric hydraulic motor which is rigidly coupled to a volumetric pump for foaming agent injection.

Such a volumetric hydraulic motor revolves at a revolution speed which is directly proportional to the flowrate of water flowing through it.

It comprises a rotary volumetric pump, which made operates in reverse mode, i.e., as a motor.

The adoption of a pump as a hydraulic motor, and making it operate in reverse mode, is already known in the art.

It is disclosed, e.g., in U.S. Pat. No. 2,543,941 and in French Pat. No. 1,150,489, with reference to reversed positive displacement pump acting as a hydraulic motor coupled with a gear pump acting as a metering pump.

In practical applications, such a combination is affected by many drawbacks.

The positive displacement pump, owing to structural reasons, cannot revolve at too high revolution speeds.

When the maximum design flowrate is increased, the revolution speed must be consequently decreased, and its displacement—and therefore its size—rapidly reach impossible values.

The output limit of the positive displacement pumps is approximately 200 $m^3$/hour. This value is extremely restrictive to the fire-fighting installation industry, wherein flowrates of the order of 1,000 $m^3$/hour may be required.

A second drawback of the above cited coupling is the limited ratio of maximum flowrate/minimum flowrate within which an acceptable mixing of the foam-extinguisher is obtained.

This limitation is due to the volumetric efficiency of the gear pump, which rapidly decreases with decreasing revolution speeds, i.e., with values of the reduced flowrate which may be required by the fire-fighting system.

Thus, the combination of the reversed positive displacement pump—acting as a motor—coupled with the gear pump—acting as the injection pump—is not suitable to adapt to the flow range demanded by the fire-fighting service.

In order to obviate these drawbacks of poor adaptability of metering gear pumps to operate at low revolution speeds, further improvements have been proposed in the prior art.

In U.S. Pat. No. 4,448,256, a revolution speed overgear is required between the hydraulic motor—still constituted by a reversed positive displacement pump—and the injection gear pump. Such a device increases the revolution speed of the gear pump, and yields a more acceptable efficiency range. However, it does not overcome the systemic drawbacks of poor adaptability to wide changes in flowrate, and of the limitations of the flowrate useable by the hydraulic motor.

French Pat. No. 1,150,489 also proposes to interpose between the foam-extinguisher additive tank and the injection pump a booster pump, which pressurizes the injection pump—still a gear pump—minimizing its inner recycle and increasing again the volumetric efficiency thereof to acceptable values.

Such a contrivance only makes it possible for the injection pump to be used for metering and not for true injection purposes.

However, such a technical solution yields considerable structural complexity.

The booster pump can be driven by an external motor, which renders the system dependent on other energy sources, or by the same hydraulic motor, which further reduces the residual pressure downstream of the hydraulic motor, owing to the larger energy amount required.

German Pat. No. 31 31 522 proposes to use, as the hydraulic motor, a turbine. This overcomes the flowrate limitations of the reversed positive displacement pump, when coupled with a foam-extinguisher additive metering pump. The metering pump can be a reciprocating pump, a gear pump, a peristaltic pump, a membrane pump, or a screw pump.

However, the turbine suffers from the drawback that it is even less adaptable to the changes in flowrate typical of the fire-fighting service. This is because the revolution speed of the turbine, and the extracted power are not in linear relationship with the flowrate of fire-fighting water. The metering precision can be only obtained within a small portion of the required flowrate range.

Although many types of volumetric pumps are, at least in principle, able to be operated in reverse mode, and are also capable of operating as a hydraulic motor, for the application of preparing foam fire-extinguisher solutions, the rotary pumps of screw-pump type have proven to be especially suitable for use as hydraulic volumetric motors. In fact, such pumps can be substantially transformed into hydraulic volumetric motors by simply reversing the flow through them, i.e., mutually exchanging their inlet and outlet.

For the flowrates, and the waterheads necessary for the application of fire-fighting services, the characteristic curves show that among the rotary pumps are preferred for the particular use in reverse mode as a volumetric hydraulic motor, due to the large water flowrate they can tolerate.

Said hydraulic motor is either directly, or with the interposition of a revolution speed reduction gear/overgear is indirectly coupled with a volumetric pump which intakes the foam-extinguisher additive and injects it into the same water duct.

The injection of the foam-extinguisher additive can be introduced either upstream or downstream of the same hydraulic motor.

In the first case, there is better mixing of the additive with water for the fire-fighting network, in the second case the opposite effect is obtained, the pressure necessary for the injection is lower.

The volumetric pump for injecting of the foam-extinguisher additive into the duct of the fire-fighting network is directly obtained from water flow, at the expense of a moderate pressure drop.

DESCRIPTION OF THE DRAWINGS

A specific embodiment of the invention will be described with reference to the following drawings wherein.

DESCRIPTION OF THE PREFERRED EMBODIMENT

Figure 1:
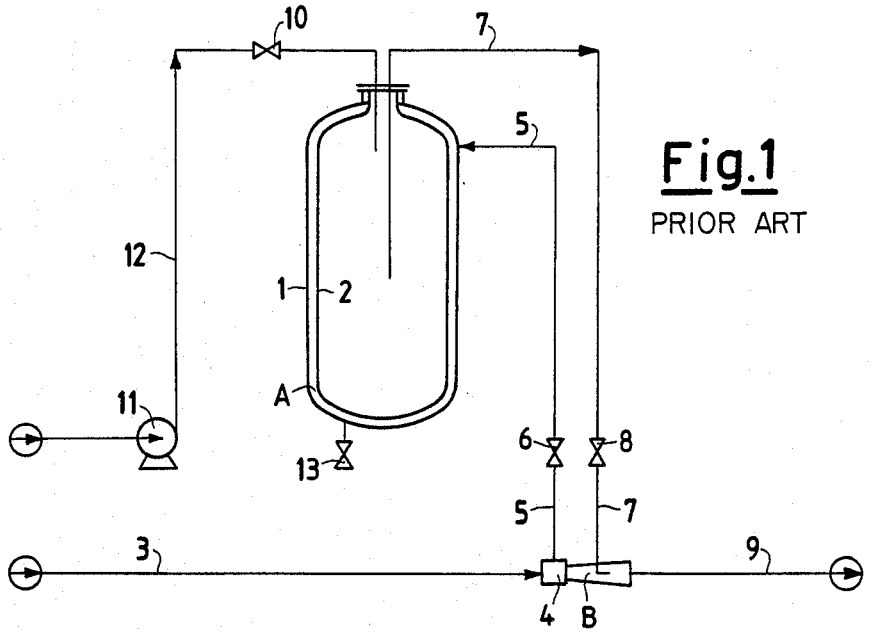
Fig.1 PRIOR ART
FIG. 1 is a schematic flow diagram of the device of the prior art.
Figure 2:
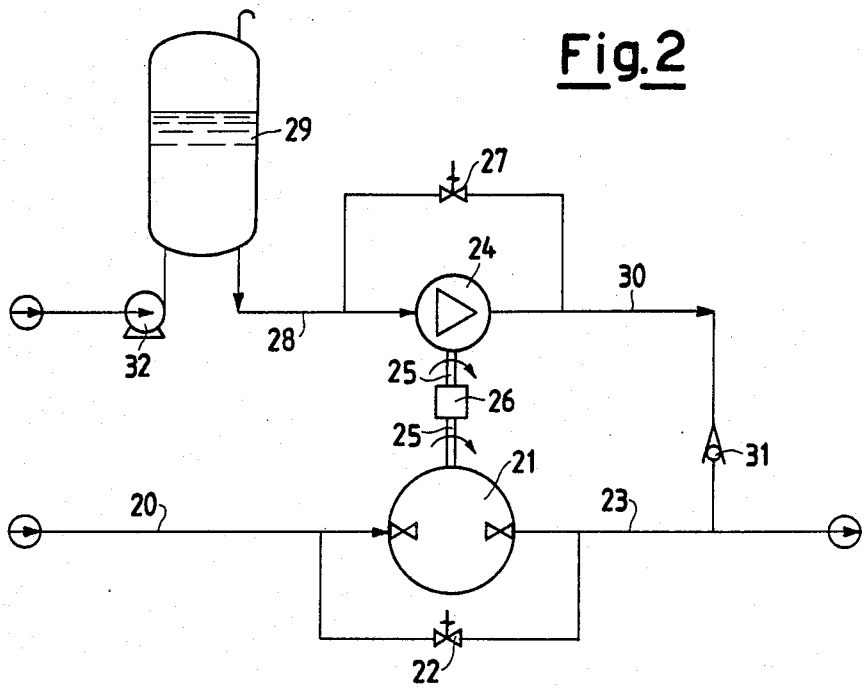
FIG. 2 is a schematic flow diagram of the device of the present invention.

A typical embodiment of the device according to the invention is depicted in FIG. 2.

The pressurized water from the fire-fighting network flows through the duct 20, and through the hydraulic volumetric motor 21, which is a volumetric screw pump operating in reverse mode.

As hereinabove stated, such a rotary volumetric pump is preferably a double-screw pump.

The volumetric motor 21 is protected by a safety valve 22, which is automatically tripped, and prevents water from flowing through 21 when, due to possible anomalies, the pressure drop inside the motor exceeds the correct operation values.

Fire-fighting water flows through 21, revolving at a speed proportional to the water flowrate, which, in turn, is a function of the amount taken from the network, and is discharged though the duct 23, under a pressure slightly lower than the pressure existing in 20. The pressure drop in the water flowing through 21 corresponds to the energy absorbed by the hydraulic motor, which is linked to the volumetric pump 24 by means of the revolving shaft 25, or another equivalent mechanical coupling.

The revolution speed reduction gear/overgear 26 can be installed in the coupling represented by shaft 25, if the two machines 21 and 24 are run at proportional speeds different from each other.

A safety valve 27, which is analogous for type and installation to valve 22, is also installed to bypass the volumetric pump 24.

In principle, the volumetric pump 24 for foam-extinguisher additive addition can be of any type.

However, when its application is the preparation of foam-extinguisher solutions, the present Applicant found that the volumetric pumps of screw-pump type are very suitable, and, among these, the three-screw volumetric pumps are preferred when the characteristic curves of the two mutually coupled machines are considered.

The volumetric pump 24 intakes, through the line 28, the foam-extinguisher additive from the tank 29 and delivers it, through the line 30, to be mixed with fire-fighting water of duct 23. On the line 30 a non-return valve 31 is interposed, in order to prevent water from returning back into the foam-extinguisher injection line, and as a protection against possible water hammers, or other back-pressures.

The storage tank 29 can be of atmospheric type, and the foaming additive can be refilled by means of the service pump 3, or other systems, even while machines 21 and 24 are running without adverse consequences.

It is furthermore possible according to the device of the present invention by means of simple structural changes, to easily modulate the ratio of fire-fighting water to foaming additive.

By suitably selecting the values of the displacements of the volumetric hydraulic motor and of the injection pump, the required percentage ratio of water to the aditive can be obtained. This ratio remains constant with varying values of the required flowrate of fire-fighting solution.

The need for preparing foam-extinguisher solutions with variable percentages of additive, because foam-extinguishers of different types may be used, can be achieved by the following different forms of practical embodiment.

When the revolution speed reduction gear/overgear 26 is used by changing the transmission ratio between the two machines, while the displacement ratio between the two machines remains the same an increased percentage of the additive will be modified because of the change in the revolutioon speed ratio between these two machines.

This embodiment requires that the revolution speed reduction gear/overgear 26 with a constant ratio of the revolution speed of the hydraulic motor to the revolution speed of the volumetric pump be replaced by a device—or speed gear—which enables such a speed ratio to be selected from a range of different available and alternatively engageable ratios.

Another interesting embodiment comprises a device whereby the volumetric motor is linked with a plurality of injection volumetric pumps, as depicted in FIG. 3, which can be engaged or disengaged acording to various combination.

For exemplifying purposes, three volumetric pumps are employed, each capable of delivering the following flowrates:

the first pump, has a flowrate equal to 1% of water flowing through the volumetric motor 21;

the second pump, has a flowrate equal to 2% of water flowing through the volumetric motor 21;

the third pump, has a flowrate equal to 4% of water flowing through the volumetric motor 21, and by means of graduated engagement of the three pumps, the delivery of the following metered amounts will be possible: -1& with the first pump only;

2% with the second pump only;

3% with the first pump and the second pump engaged;

4% with the third pump only;

5% with the first pump and the third pump engaged;

6% with the second pump and the third pum engaged;

7% with all pumps engaged.

Figure 3A:
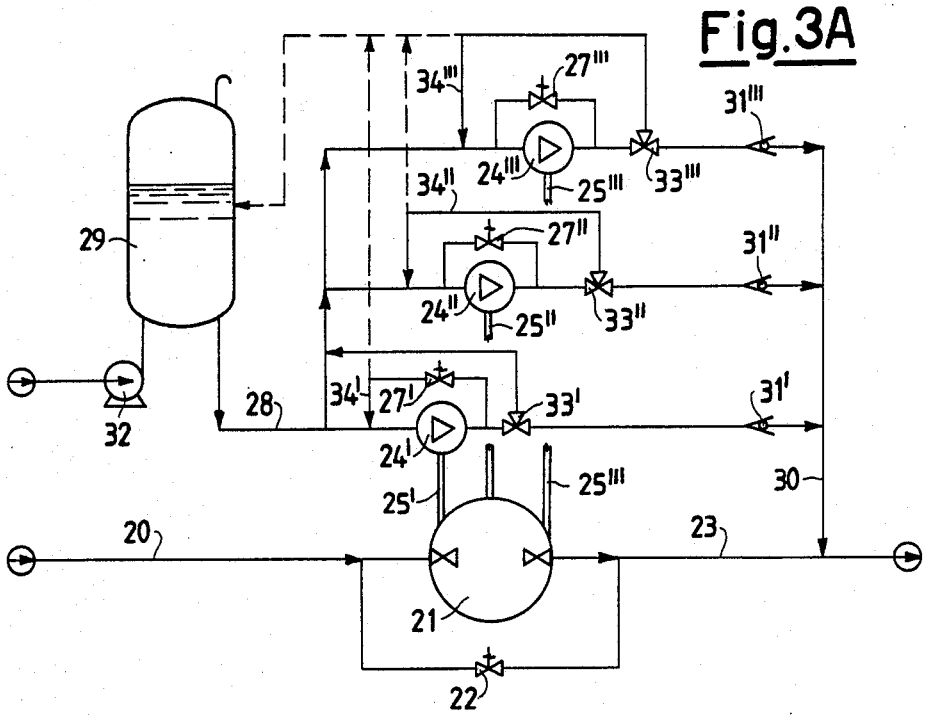
FIG. 3A is a schematic flow diagram of another embodiment of the device of the present invention.

The diagram depicted in FIG. 3A schematically represents such practical embodiment, wherein 24', 24'' and 24''' are the three different volumetric pumps with their connections and accessories (27', 27'' and 27''' are the three safety valves; 25', 25'' and 25''' are the three coupling shafts; 31', 31'' and 31''' are the three non-return valves). The modulation of the flowrate is carried out by means of the three-way valves 33',33'' and 33''' respectively installed downstream of 24', 24'' and 24'''.

Such three-way valves have two possible positions. The first position allows the flowrate of the volumetric pump to go to duct 30, and the second position recycles the flowrate upstream of the same pump, by means of the pipes 34', 34'' and 34'''. As an alternative, the flowrate can be recycled to the tank 29 by means of the pipes shown in short-dash lines.

It is clear that the volumetric pumps 24', 24'' and 24''' are always kept running and that, when one of valves 33 is switched into its recycle position, the water head required from the corresponding volumetric pump is very low, and the power absorbed from the corresponding link 25 is therefore very small.

Figure 3B:
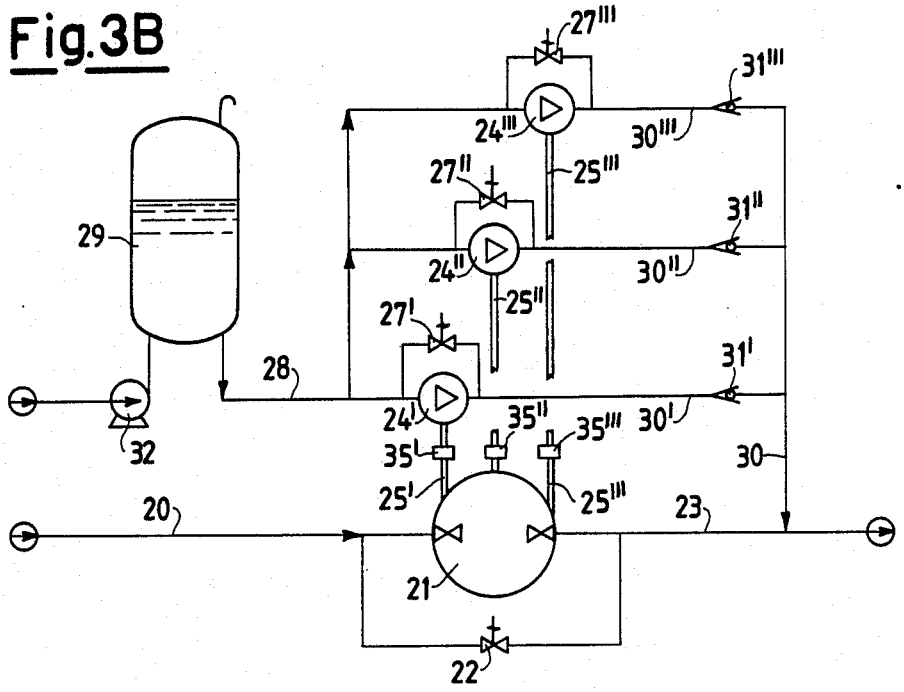
FIG. 3B is a schematic flow diagram of still another embodiment of the device of the present invention.

According to the diagram depicted in FIG. 3B, the modulation of flowrate is carried out by means of the mechanical couplings 35', 35'' and 35''', respectively installed in the mechanical links 25', 25'' and 25''', and can respectively engage or disengage from the power transmission the volumetric pumps 24', 24'' and 24'''.

According to this latter form of practical embodiment, the volumetric pumps 24 are kept running only during the time during which their flowrate is necessary for delivering the desired metered amounts of foam-extinguisher additive.

From the above, advantages of the device are quite important in its application for the preparation of the foam fire-extinguisher solutions for fire-fighting systems.

Among such advantages as compared to the apparatuses known from the prior art, the following deserve a special attention.

The device according to the present invention makes it possible for the additive to be precisely and constantly metered throughout the flowrate range of the fire-fighting system.

On the contrary, the ejector—or Venturi—devices known from the prior art show a characteristic curve of flowrate/metered amount which, in its central portion, as very close to a straight line, whilst in its portions corresponding to low flowrates and to maximum flowrates, such a characteristic curve substantially departs from the straight line of the central portion, and does not any longer ensure a correct metering.

The device according to the present invention is capable of metering precise and constant volumes as well as when additives are mixed at low percentages (3% and 1% for the most recent foam-extinguishers). The Venturi devices according to the prior art, on the contrary, cannot be used at such low percentages.

The device according to the present invention makes it possible for additives requiring different metering rates to be rapidly interchanged. On the contrary, this is not feasible in case of the devices according to the techniques known for the prior art. According to the prior art, using reduced amounts of an additive which has to be metered—under emergency conditions—, requires a preliminary dilution of such an additive.

In addition to the disadvantages of time waste and of additional work, any advantage of the longer autonomy of operation allowed by reduced-metering additive gets of operation allowed by reduced-metering additive gets lost.

The device according to the present invention does not require pressurized tanks, uses atmospheric tanks, and can be the normal containers in which the additive is transported.

Non practical limitations exist in the operation of the fire-fighting system, which do not require different tanks be used, and which are alternatively switched into refilling mode and operating mode in short time intervals, as it occurs in case of the apparatuses known from the prior art.

The device of the present invention is not subject to the drawbacks deriving from the flexible membranes, or from the separation pistons provided inside the tanks, which are the critical part of the prior art devices.

Regarding other solutions proposed in the prior art, such as e.g., coupling gear pumps with hydraulic motors which are positive displacement pumps operating in reverse mode, or by hydraulic turbines, the present invention shows many advantages.

Since the motor and the injection pump are the screw type, both machines have congruent speeds and characteristics characteristic curves, and when directly coupling the machines with each other, neither underuse, nor need for interposing speed limiting devices. The screw pumps which are used as the hydraulic motor can operate at flowrates as high as 1,000 $m^3$/hour and higher, with maximum revolution speeds as high as 3,000 revolutions per minute.

The possibility of revolving at high speeds enables machines of small displacement and size to be used, with incidence of recycles being reduced, and with their range expanded to low flowrates and with the characteristics of a precise metering and high efficiencies being always maintained.

What is claimed is:

1. In a fire fighting system which provides extinguisher foam from a source and mixes the foam with fire fighting water flowing through a line at variable flow rates, a device for continuously delivering a proportionately constant fire fighting extinguisher solution using only the energy supplied by the pressure of the water, comprising:

(a) a volumetric hydraulic motor in said fire fighting water line driven by the pressure energy of the fire fighting water passing therethrough;

(b) a plurality of foam additive metering devices operatively connected to said motor for receiving extinguisher foam additive and metering the extinguisher foam additive in response to the volume of water flowing through said motor, to thereby provide a proportionately constant fire fighting solution using only the energy supplied by the pressure of the fire fighting water;

(c) means for engaging or disengaging at least one of said metering devices from said pump; and (d) means for recycling the dicharge of foam from each of said metering devices back to its source.

2. In a fire fighting system which provides extinguisher foam from a source and mixes the foam with fire fighting water flowing through a line at variable flow rates, a device for continuously delivering a proportionately constant fire fighting extinguisher solution using only the energy supplied by the pressure of the water, comprising:

(a) a volumetric hydraulic motor in said fire fighting water line driven by the pressure energy of the fire fighting water passing therethrough wherein said motor comprises a double screw rotary pump, and wherein said motor is connected to said metering device by a shaft rotatable by said motor; and (b) at least one foam additive metering device operatively connected to said motor for receiving extinguisher foam additive and metering the extinguisher foam additive in response to the volume of water flowing through said motor, to thereby provide a proportionately constant fire fighting solution using only the energy supplied by the pressure of the fire fighting water, wherein said metering device comprises a three screw pump;

(c) means for engaging or disengaging at least one of said metering devices from said pump;

(d) and means for recycling the discharge of foam from each of said metering devices back to its source.

3. The device of claim 1, wherein said motor comprises a double screw rotary pump.

4. The device of claim 1, wherein said metering device comprises a three screw pump.

5. The device of claim 1 or 2, wherein the connection between said motor and said metering device comprises a revolution speed reduction gear/overgear which causes said motor and said metering device to revolve at different speeds proportional to one another.

6. The device of claim 5, wherein the speed reduction gear/overgear further comprises a plurality of different transmission ratios which can alternatively engage.

7. The device of claim 1 or 2 wherein the device includes a plurality of said metering devices, and wherein said device further includes means for engaging or disengaging at least one of said metering devices from said pump.

8. The device of claim 1 or 2 wherein the device includes a plurality of said metering devices, and wherein said device further includes means for engaging or disengaging at least one of said metering devices from said pump and a mechanical coupling means for disengaging the connection between said motor and said metering device.

* * * * *